US006783612B2

(12) United States Patent
Benedetti

(10) Patent No.: US 6,783,612 B2
(45) Date of Patent: Aug. 31, 2004

(54) METHOD AND APPARATUS FOR IN-LINE HEAT TREATMENT OF HOT ROLLED STOCK

(75) Inventor: Gianpietro Benedetti, Campoformido-Udine (IT)

(73) Assignee: Danieli Technology, Inc., Cranberry Township, PA (US)

( * ) Notice: Subject to any disclaimer, the term of this patent is extended or adjusted under 35 U.S.C. 154(b) by 301 days.

(21) Appl. No.: 09/976,209

(22) Filed: Oct. 13, 2001

(65) Prior Publication Data

US 2003/0084974 A1 May 8, 2003

Related U.S. Application Data

(62) Division of application No. 09/315,848, filed on May 21, 1999, now Pat. No. 6,336,980.

(51) Int. Cl.[7] ..... C21D 8/00
(52) U.S. Cl. ..... 148/654; 148/653
(58) Field of Search ..... 148/653, 654

(56) References Cited

U.S. PATENT DOCUMENTS

| | | | | |
|---|---|---|---|---|
| 4,786,338 | A | 11/1988 | Anzawa et al. | 148/12.4 |
| 5,329,688 | A | 7/1994 | Arvedi et al. | 29/527.7 |
| 5,333,366 | A | 8/1994 | Guse | 29/33 |
| 5,423,200 | A | 6/1995 | Shore | 72/201 |
| 5,460,220 | A | 10/1995 | Coassin | 164/483 |
| 5,488,987 | A | 2/1996 | Di Giusto et al. | 164/452 |
| 5,528,816 | A | 6/1996 | Donini et al. | 29/527.7 |
| 5,601,138 | A | 2/1997 | Di Giusto et al. | 164/452 |
| 5,634,512 | A | 6/1997 | Bombardelli et al. | 164/455 |

FOREIGN PATENT DOCUMENTS

EP 0 776 708 A1 6/1997

EP 0 862 954 A1 9/1998

OTHER PUBLICATIONS

Bernshtein, M.L.; Brun, L. Ya.; Zaimovskii, V.A.; Savari, P.; Samedov, O.V., Inheritance of the thermomechaniccal strengthenin of 30Kh2GMT (chromium–manganese–molybdenum–titanium) steel, Fiz. Metal. Metalloved. (1971), 32(4), 813–18 (Provided Abstract Only).

Japan laid Open Pat. Appln. No. HEI 63–149316, Takazuka, et al.

U.S. patent Appln. S.N. 09/315,843 filed May 21, 1999.

U.S. patent Appln. S.N. 09/315,845 filed May 21, 1999.

U.S. patent Appln. S.N. 09/315,847 filed May 21, 1999.

U.S. patent Appln. S.N. 09/315,846 filed May 21, 1999.

U.S. patent Appln. S.N. 09/315,844 filed May 21, 1999.

Matveev B. N. "The Latest In The Production Of Beams And Structural Shapes" Steel in Translation, GB, The Institute Of Materials, London, vol. 26, No. 3, pp. 53–59, 1996, XP000689710.

M. Lestani "New Concepts in the Production of Speciality Steels in Bars and Coils" La Revue de Metallurgie—CIT, Oct. 1, 1997, pp. 1225–1236, XP–000734342.

European Search Report dated Jan. 21, 2000 and Annex.

*Primary Examiner*—Sikyin Ip
(74) *Attorney, Agent, or Firm*—Armstrong, Kratz, Quintos, Hanson & Brooks, LLP

(57) ABSTRACT

Apparatus for the rolling and heat treatment of elongated metal product of relatively small cross section, such as rods and bars, is described in which the elements required for the conduct of a variety of heat treatments are arranged in in-line disposition whereby any of several heat treatment procedures can be performed on the product without need for transferring the product to remotely located heat treatment facilities. The methods of performing various heat treatments through use of the disclosed apparatus are also described.

10 Claims, 20 Drawing Sheets

METHOD AND APPARATUS FOR IN-LINE HEAT TREATMENT OF HOT ROLLED STOCK

This application is a divisional of prior application Ser. No. 09/315,848 filed May 21, 1999 now U.S. Pat. No. 6,336,980.

FIELD OF INVENTION

This invention relates to the hot rolling of elongated product, such as steel bars. More specifically, the invention concerns means and methods of in-line heat treating and finishing of the product.

DESCRIPTION OF PRIOR ART

Various systems are known for heat treatment of hot rolled products, such as bars. However, when the billets or blooms are produced in a caster such processes and facilities normally utilize off-line heat treating of the cast and hot rolled stock. It is known to perform certain limited heat treatments on the cast product before rolling. For example, U.S. Pat. No. 5,634,512 describes in-line thermal surface treatment of continuously cast blooms using cooling sprays to produce a bloom surface temperature of about 400–900° C. after tempering caused by the hot core of the bloom. U.S. Pat. No. 4,786,338 discloses a system wherein product from a finishing mill is followed by a cooling line made up of a quenching zone and a temperature recovery zone before being passed to cooling beds for obtaining low temperature toughness. Japanese Published Patent Application No. Hei 63-149316 describes a method of producing steel bars and wire rods through continuous hot rolling for obtaining a directly spheriodized structure in which spheriodizing annealing is facilitated or possibly even eliminated.

Such prior art has the drawback of being limited in the capability of producing a wide variety of metallurgical structures in the rolled stock. Off-line heat-treatments to produce various microstructures normally require treatment times of 10–15 hours.

SUMMARY OF THE INVENTION

The apparatus of this invention is disposed in an intermediate position between a hot-rolling mill and a cold-finishing area for cleaning the rolled stock, cutting it to final form, bundling and packaging it for in-line production of a final product. The apparatus includes, in-line, and downstream of a hot rolling mill train, a thermocontrolled rolling device including a controlling temperature device and a sizing mill, shears, a quenching box, optionally an induction heater, a layers preparation system where layers of cut stock, such as bars, are consolidated prior to transfer to an annealing furnace, and thereafter to a cooling bed.

By selection of particular ones of these apparatus elements for use in particular cases of heat treatment, and by selection of the conditions of heat treatment, a great variety of product structures can be achieved, for example, a spheroidized steel product, a shearability or workability annealed product, a recrystallation annealed product, a solution annealed product, a quenched product (martensitic or bainitic quenching), or a quenched and tempered (quenched and stress-relieved) product.

With practice of the in-line heat treatments of this invention, prior art off-line treatment times of 10–15 hours can be reduced to about 1 to 2 hours.

For a better understanding of the invention, its operating advantages and the specific objectives obtained by its use, reference should be made to the accompanying drawings and description which relate to preferred embodiments thereof.

DESCRIPTION OF THE PREFERRED EMBODIMENTS OF THE INVENTION

The disclosed invention is particularly directed to a plant 10 for the production of "long products", i.e. billets or blooms from about forty meters or more in length, used in the production of bars, wire, rod, rebar, or shaped beams or angles, and the like, in which the production machinery utilized is typically smaller in size than that used in the production of sheet material from slabs. As used herein, the word, "billet", shall include blooms or slabs, or other strand forms produced by a continuous caster and useful in the production of the aforementioned intended product.

Figure 1:
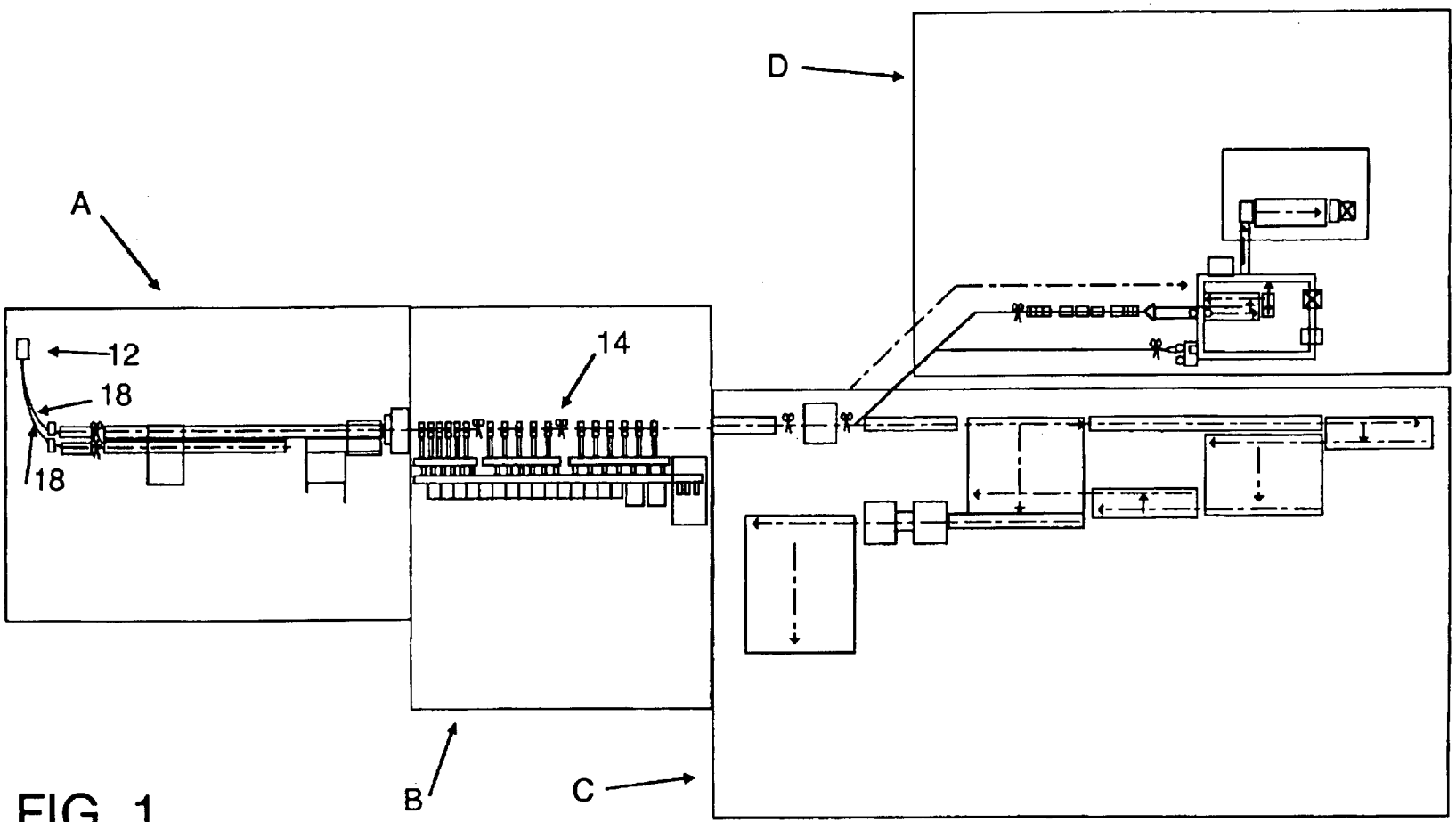
FIG. 1 is a schematic representation illustrating an overall plant layout incorporating the invention.

FIG. 1 of the drawings shows a schematic representation of an overall plant layout suitable for the practice of the present invention. The described plant comprises a casting/mill entry area A, a rolling mill/stands store area B, a finishing area C for the in-line heat treatment of product; and a finishing area D for the in-line heat treatment of wire rod and bars. A description of the respective areas of the plant is presented hereinafter.

A. The Casting/Mill Entry Area

As shown in the schematic representation of FIG. 1, the casting/mill entry area A of the plant includes that area of the plant beginning with the continuous casting equipment 12 and extending essentially to the entrance to the roughing mill stand 16 of the rolling mill 14.

Figure 2:
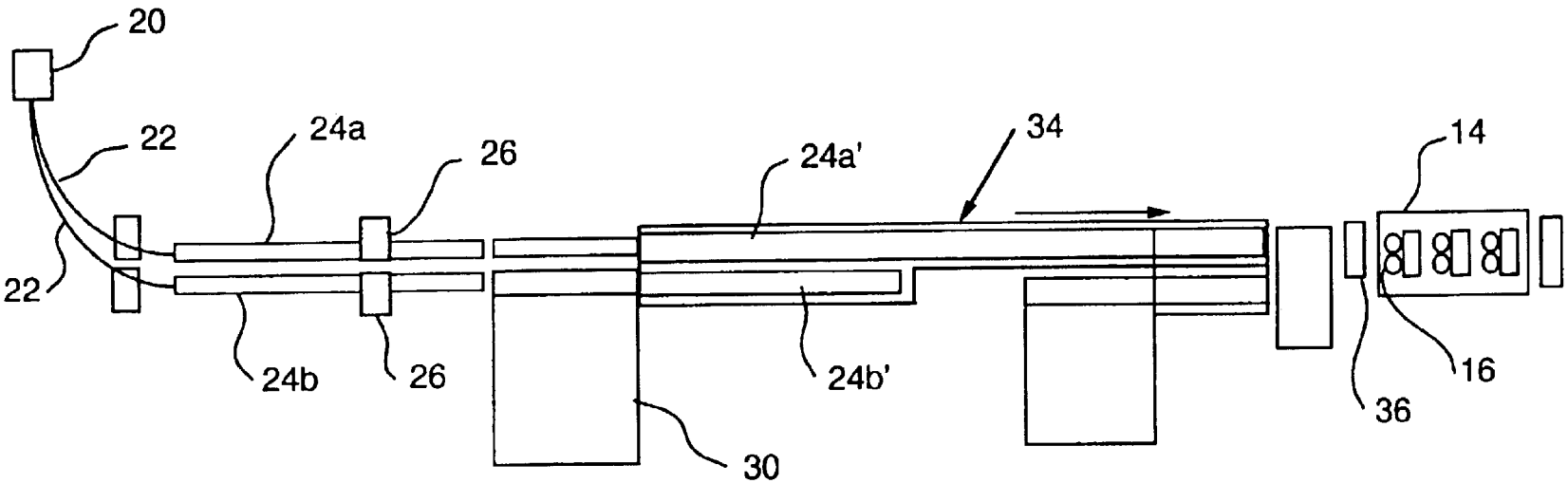
FIG. 2 is a somewhat enlarged schematic of the casting/mill area of the plant shown in FIG. 1.

In FIG. 2 the production line is shown in somewhat more detail as containing continuous caster equipment 12 which may be operable for producing a pair of billets 18. The caster equipment 12 comprises a mold 20 which, as is well known, receives molten metal from a tundish (not shown), or the like, and delivers a plurality (here shown as a pair) of billet strands 22 to a conveyor 24, typically a roll conveyor, suitable for conveying high temperature metal product. Depending upon the ultimate shape of the product to be produced, the caster strands may be billet strands, as embodied in the described line, or they may be of bloom or other dimensions. In either event, the plant 10, being intended for the production of rolled bar, wire product or other elongated shaped product, will produce strands of predetermined dimensions suitable for the ultimate production of the desired elongated product.

The illustrated production line contains a pair of in-line shears 26 which may be of the blade or flame-type. A quenching box 28, a cooling bed 30 and a reheat furnace 32 optionally may also be disposed in an "in-line" configuration in the production line. A tunnel furnace 34, whose principal function it is to heat up and to equalize the temperature of the billets and to bring them to a rolling temperature prior to their being passed to the rolling mill 14, as hereinafter more fully described, is provided upstream of the roughing mill stand 16. A dividing and cropping shear 26 is disposed in each of the lines for cutting the product strands to length, which is contemplated to be upwards of forty meters in length.

According to the invention, one of the conveyors, indicated as 24*a* in the drawings, and adapted to receive one of the billet strands 22 from the caster, extends the length of the production line in alignment with the entrance to the rolling mill 14, as determined by the entrance end of the roughing mill stand 16. The adjacent conveyor, indicated as 24*b* in the drawings, extends parallel to the first conveyor 24*a* continuously from its position to receive a billet strand and convey it to a position spaced inwardly of the outlet of the tunnel furnace 34.

Advantageously, a descaling assembly 36, as shown in FIG. 2, can be disposed in conveyor line 24*a* intermediate the discharge end of the tunnel furnace 34 and the entrance to the roughing mill stand 16. The descaling assembly 36 may be of any well known type but preferably is of the water-operated type including rotary nozzles (not shown) providing a high pressure impact and a low overall rate of water flow so as to reduce to a minimum the loss of temperature from the billet 18 passing to the rolling mill. Between the tunnel furnace 34 and mill inlet, in an advantageous elimination of surface defects before entering the mill. The device 35 may comprise in-line grinding systems or in-line scarfers using a special flame for eliminating the billet surface layer.

The tunnel furnace 34 may be heated by any of a number of available heating sources including free flame burners, radiating pipes, induction heaters, or any combination of these, either with or without a protective atmosphere. The tunnel furnace 34 is of a size to receive both conveyors 24*a* and 24*b* and is of a length to accommodate the product being conveyed along the respective conveyors. Exiting the tunnel furnace 34, as illustrated, is the tunnel furnace discharge end of conveyor 24*a* which is aligned with the entrance to the roughing mill stand 16.

Figure 3:
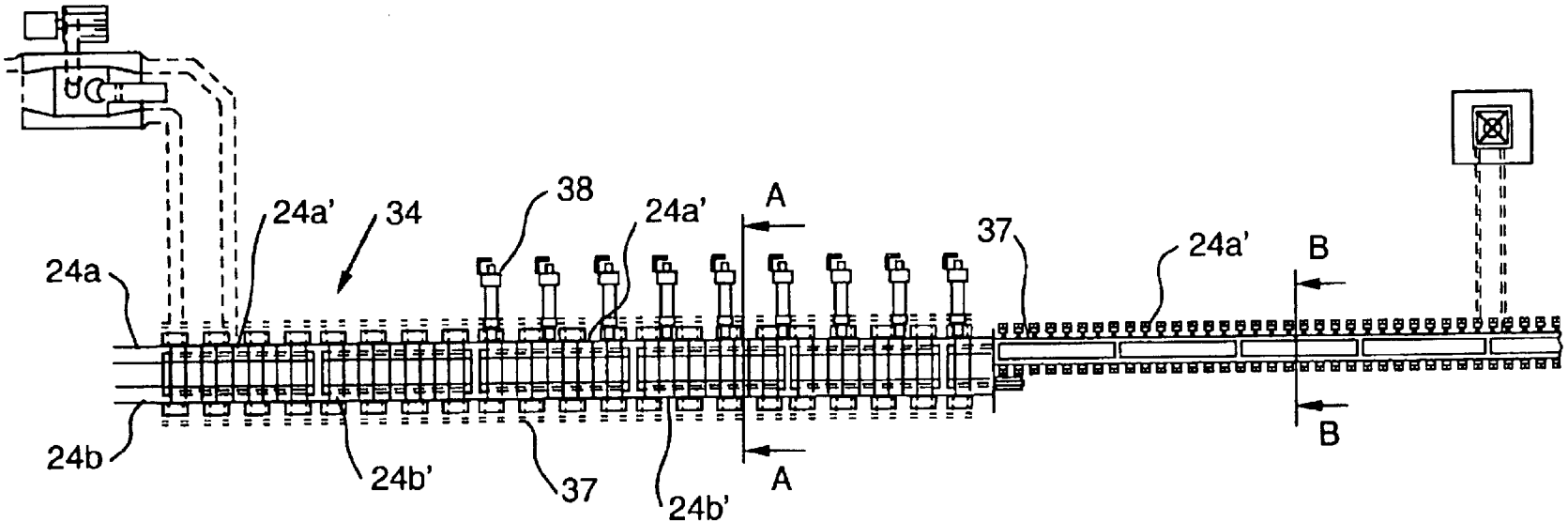
FIG. 3 is a plan view of a tunnel furnace and outlet conveyor therefrom of the type suitable for use in the plant shown in FIG. 1.
Figure 4:
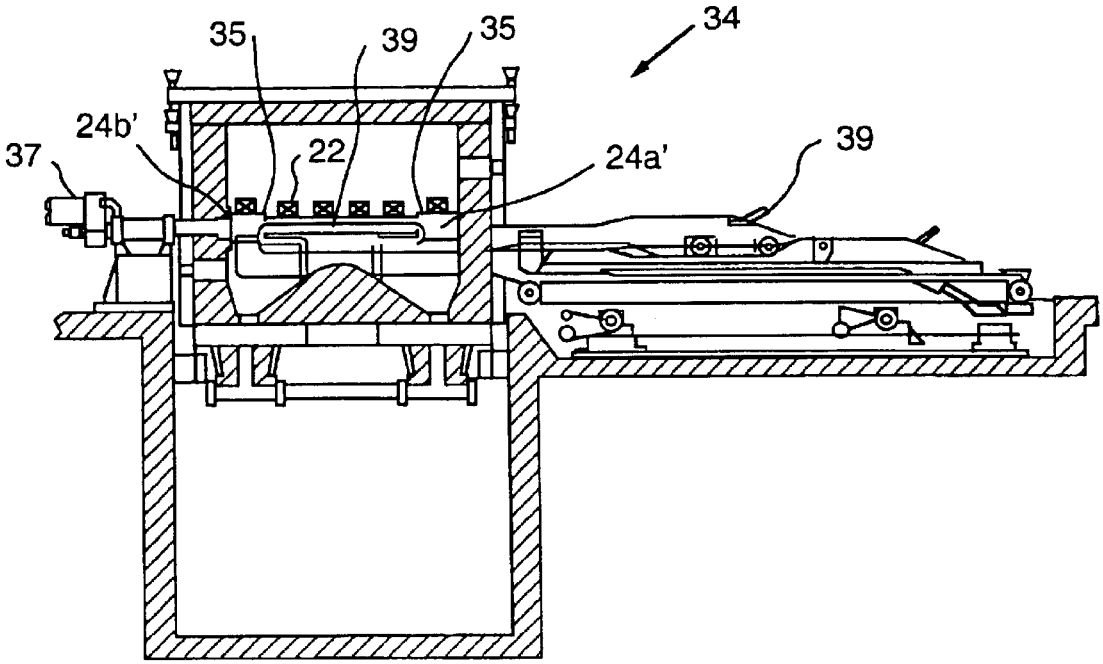
FIG. 4 is a sectional view of one embodiment of the tunnel furnace taken along line A—A of FIG. 3.
Figure 5:
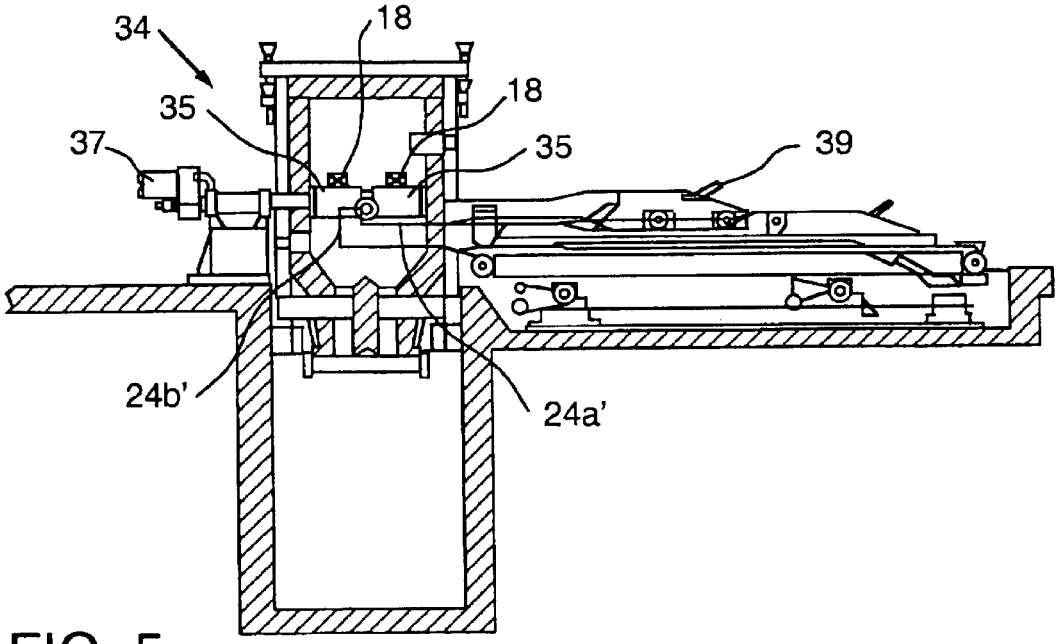
FIG. 5 is a sectional view, similar to FIG. 4, of another embodiment of the tunnel furnace taken along line A—A of FIG. 3.
Figure 6:
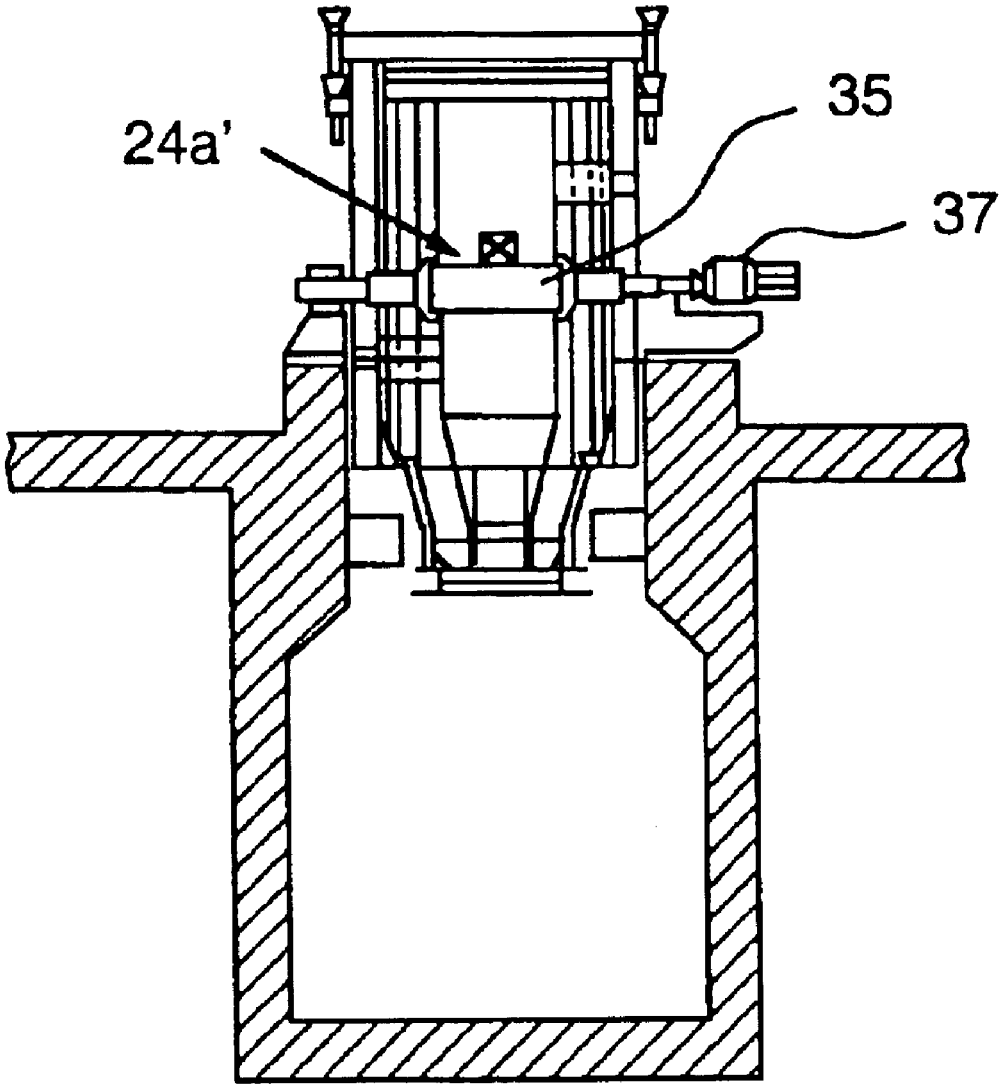
FIG. 6 is a sectional view of the tunnel furnace discharge conveyor taken along line B—B of FIG. 3.

As shown in FIG. 3 the longitudinally parallel conveyors 24*a* and 24*b*, which each comprise a series of transversely parallel rollers 35 rotatably driven by motors 37, are arranged to convey billets 18 from the respective caster strands 22 to the tunnel furnace 34. In the tunnel furnace 34 the conveying rollers are enclosed within walls having a thermal resistant lining. Openings are provided in the furnace walls to accommodate penetration of connecting shafts extending between the motors and the rollers 35. As shown best in FIG. 4 the rollers 35 defining the conveyors 24*a*' and 24*b*' may be mutually separated by conductor beams 39' whose temperature is maintained by a transfer of heat with respect to fluid circulated through heat transfer line 41. In an alternative embodiment of the tunnel furnace 34 shown in FIG. 5, the conductor beams 39' and heat transfer line 41 are eliminated.

According to the invention, means are provided to insure the placement of the billets 18 in close end-to-end alignment at the time of delivery to the rolling mill 16 so that the rolling operation performed on billets from the respective strands 22 is conducted substantially continuously. Thus, as shown, the billet transfer device 38 comprises a series of movable structures 39 that penetrate the furnace wall on one lateral side along substantially the full length of the respective conveyors within the tunnel furnace 34. In operation, those segments of conveyors 24*a* and 24*b* within the tunnel furnace 34, identified as segments 24*a*' and 24*b*', respectively, produce a running velocity for the billets 18 variable in relation to the continuous feeding cycle phase of the billet to the rolling mill. An illustrative operating cycle is described hereafter.

Figure 7:
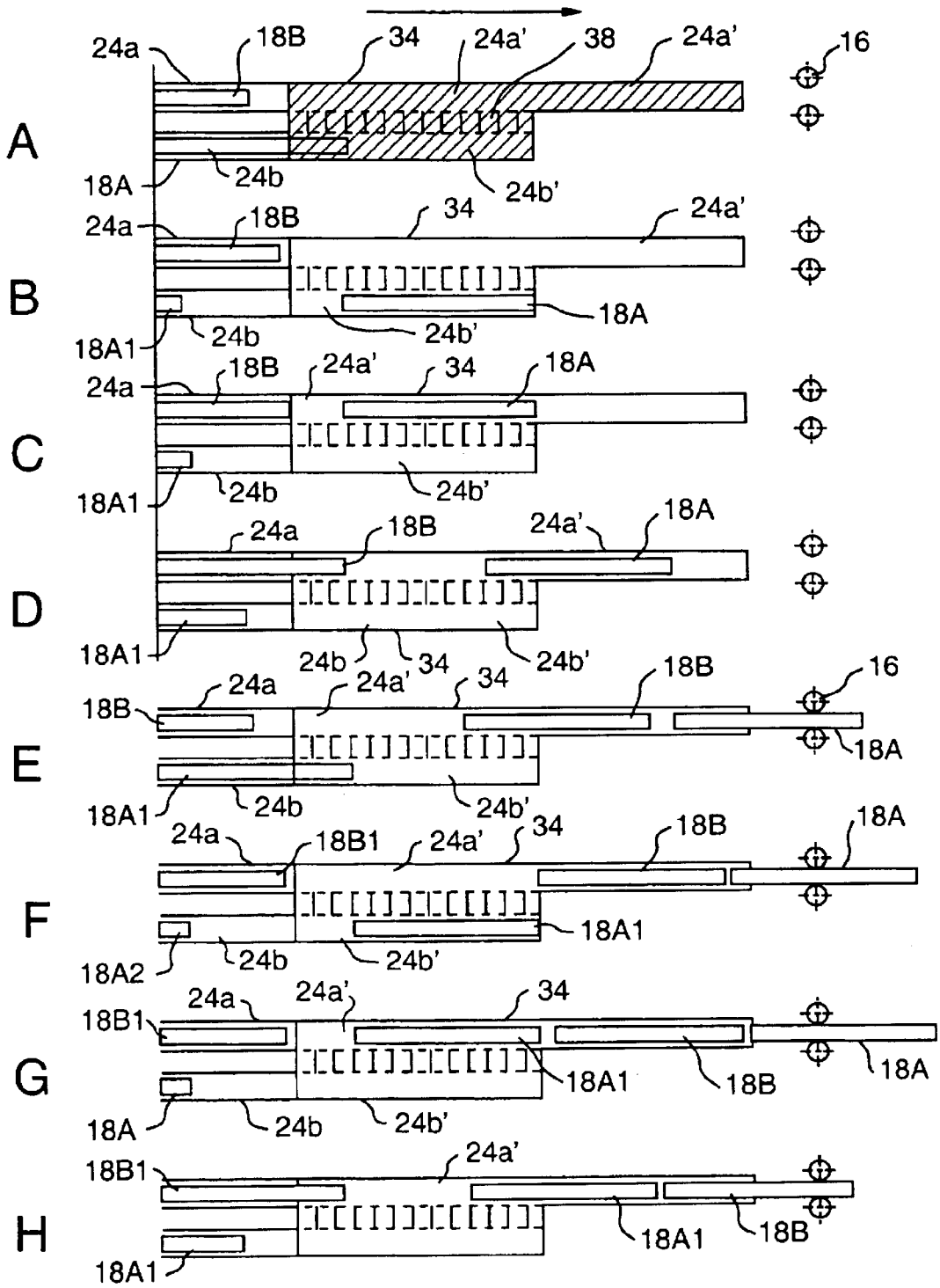
FIG. 7 is schematic diagram consisting of steps A to H indicating the sequencing of billets within the tunnel furnace for transferring said billets from parallel conveyors into alignment on a single conveyor for conduct to the rolling mill in accordance with the present invention.

Consequently, the operating procedure of the disclosed equipment can be appreciated from consideration of Steps (A) through (H) in FIG. 7 of the drawings. In operation, with billet $\mathbf{18}_A$ on conveyor 24*b* and billet $\mathbf{18}_B$ on conveyor 24*a* and lagging billet $\mathbf{18}_A$, billet $\mathbf{18}_A$ enters the tunnel furnace 34 and is received upon conveyor 24*b*' (Step A). Due to the increased velocity of conveyor 24*b*', billet $\mathbf{18}_A$ is moved at a greater velocity to the end of the conveyor and stopped (Step B). In the meantime, immediately prior to the entry of billet $\mathbf{18}_B$ on conveyor 24*a* into the tunnel furnace 34, billet $\mathbf{18}_A$, by operation of the transfer apparatus 38, is transferred from conveyor 24*b*' to conveyor 24*a*' in forwardly spaced relation from billet $\mathbf{18}_B$ (Step C). Thereafter, billet $\mathbf{18}_A$ and billet $\mathbf{18}_B$ are both conducted on the conveyor 24*a*' with billet $\mathbf{18}_A$ being conducted from the tunnel furnace 34 through the descaling assembly 36 toward the entrance to the roughing mill stand 16 and billet $\mathbf{18}_B$ being simultaneously conducted into the tunnel furnace (Step D).

During this period, a following billet, designated in the drawings as billet $\mathbf{18}_{A1}$, which is in lagging relation with respect to billet $\mathbf{18}_B$ on conveyor 24*a*, has been conveyed by conveyor 24*b* toward the entrance of the tunnel furnace 34 (Steps B to D). Billet $\mathbf{18}_{A1}$ enters the tunnel furnace 34 on conveyor 24*b* to be received on conveyor 24*b*' as billet $\mathbf{18}_B$ is leaving the part of the roller table 24*a* which will then be occupied by billet $\mathbf{18}_{A1}$ (Step E). As indicated previously, the running speeds of the respective conveyors, 24*a*, 24*b*, 24*a*' and 24*b*', are controlled to be time-variable for performing the described working cycle.

As shown in Step (F) billet $\mathbf{18}_A$ is conducted through the roughing mill 16 at rated rolling speed to the position indicated in the drawing figure. While billet $\mathbf{18}_A$ is rolled, billet $\mathbf{18}_B$ is brought to a position immediately adjacent the rearward end of billet $\mathbf{18}_A$ wherein it is substantially contiguous therewith. This establishes sufficient space on conveyor 24*a*' rearwardly of billet $\mathbf{18}_B$ to permit billet $\mathbf{18}_{A1}$ to be transferred to conveyor 24*a*' from conveyor 24*b*' by the transfer device 38. As billets $\mathbf{18}_A$ and $\mathbf{18}_B$ are conveyed at rated rolling speed through the rolling mill and descaling assembly, respectively (Step G), billet $\mathbf{18}_{A1}$ is transferred to conveyor 24*b*' and moved into close, substantially contiguous relation with the rear end of billet $\mathbf{18}_B$ (Step H). At this time billets are $\mathbf{18}_{B1}$, $\mathbf{18}_{A1}$ and $\mathbf{18}_{A2}$ are at locations corresponding to billets $\mathbf{18}_B$, $\mathbf{18}_A$ and $\mathbf{18}_{A1}$ shown in Step (D) whereupon the operating cycle continues in a repeating manner.

B. Automated Rolling Mill Administration System

Figure 8:
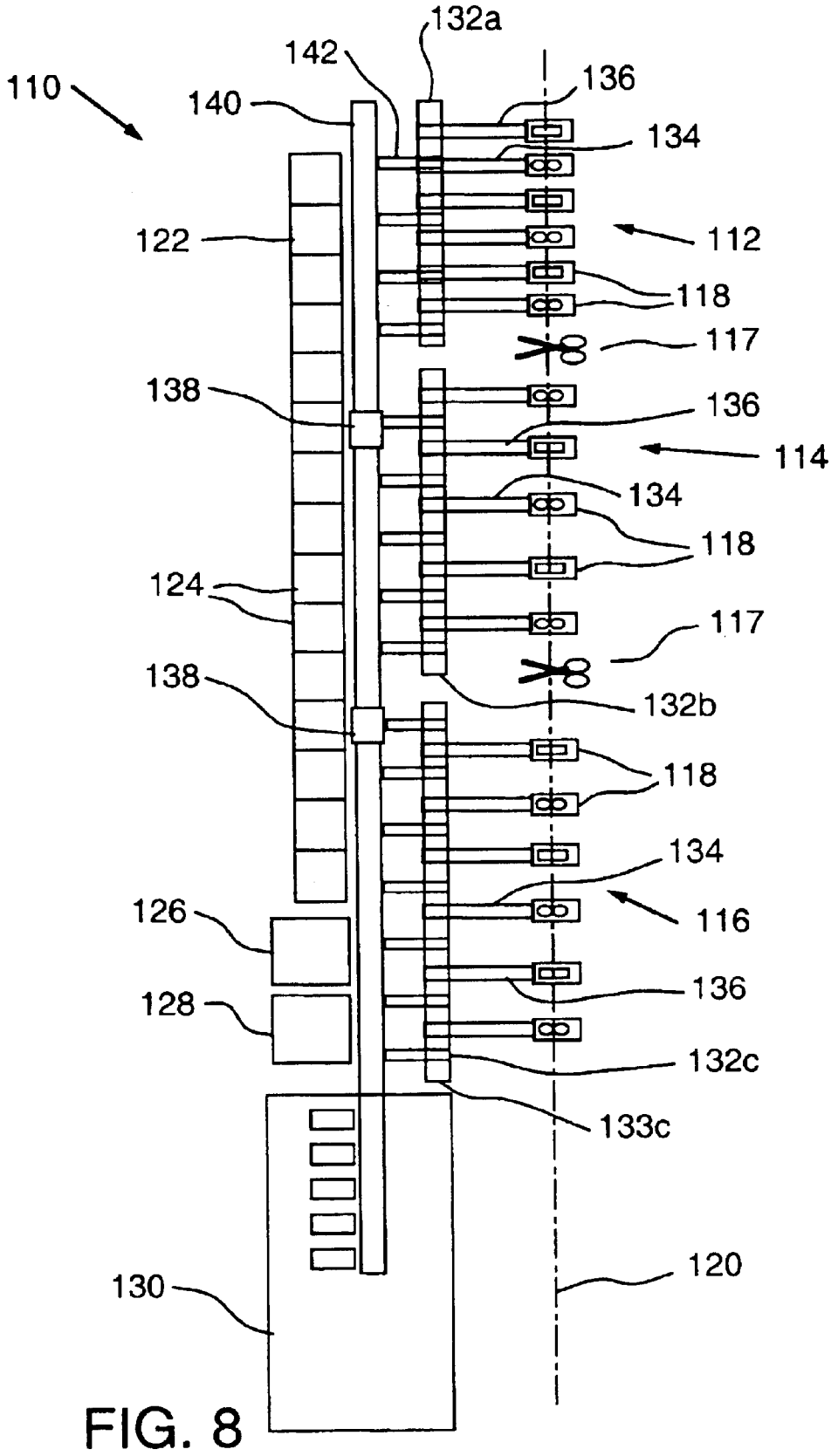
FIG. 8 is a schematic layout of the rolling mills/stand storage area of the plant shown in FIG. 1.
Figure 9:
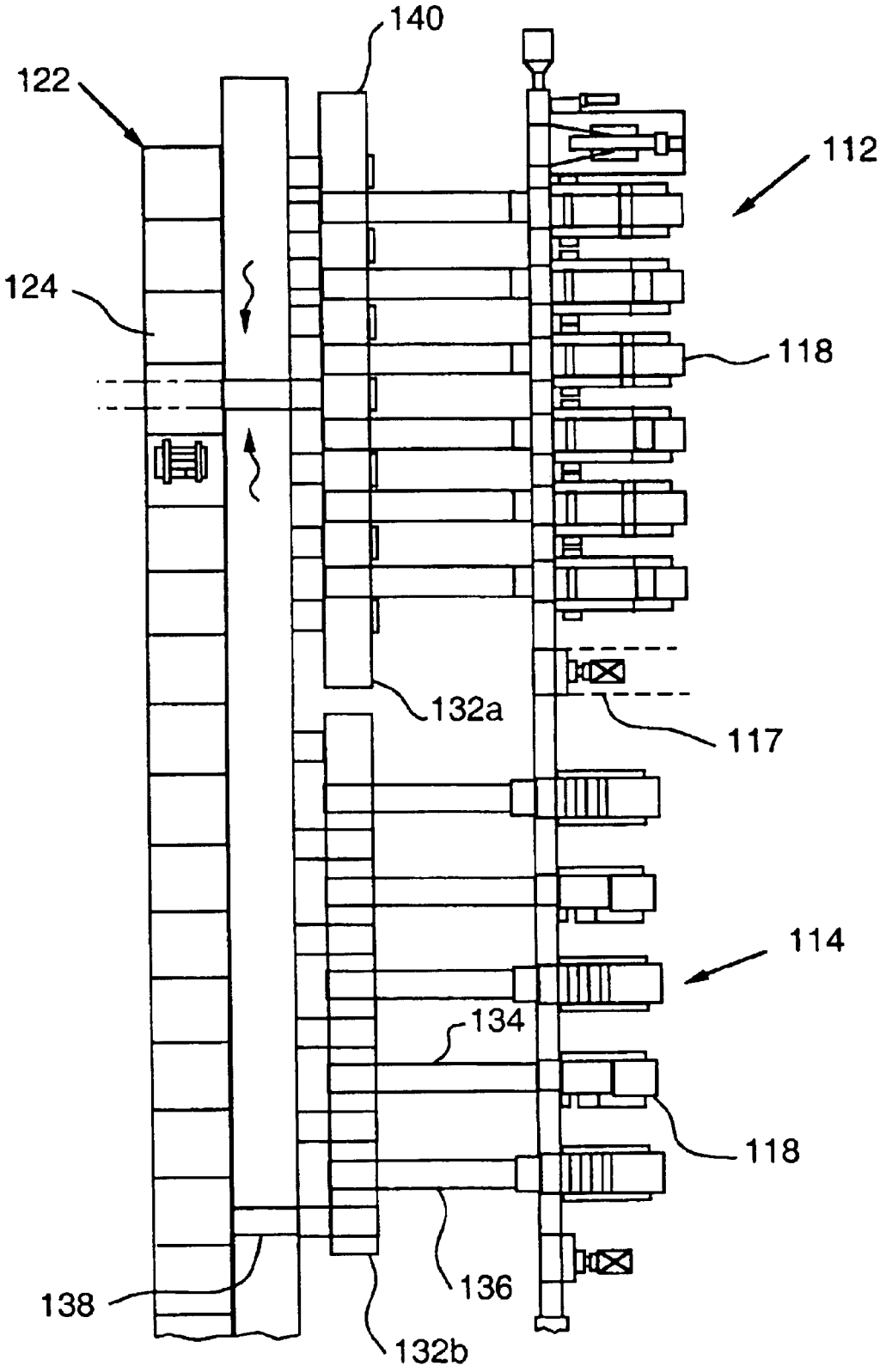
FIG. 9 is a somewhat enlarged illustration of a typical portion of the rolling mill/stand storage area shown in FIG. 8.

With reference to FIG. 8 of the drawings there is shown a general layout of the rolling mill stands storage area 110 of the described plant 10. FIG. 9 illustrates a portion of the equipment in slightly greater detail. As shown, the rolling mill 14 contains sections comprising a roughing mill section 112, an intermediate mill section 114 and a finishing mill section 116, each of which sections contains a plurality of rolling mill stands 118 disposed in-line along a roll pass line 120 identified by a dot-dash line. As shown, the rolling mill stands 118 in the respective mill sections are arranged for the rolling of billets 18 produced by the continuous casting equipment 12 whereby, as shown, the axes of the roll sets of adjacent stands 118 in the respective mill sections 112, 114 and 116 are mutually perpendicularly offset, as is common in the production of elongated metal products, such as bars and rods, or the like, in order to accurately size and shape the product being rolled. Selectively operable shears 117 may optionally be positioned between the respective mill sections.

In addition to the illustrated rolling mill 14, which may include more or less than the number of rolling mill sections shown, as well as more or less than the number shown of mill stands 118 in each rolling mill section, the concerned region of the plant contains a multi-story stand storage area 122 extending parallel to the roll pass line 120. The stand storage area 112 comprises a warehousing facility containing a plurality of stacked compartments 124 arranged in side-by-side relation into which mill stands 118 and by-pass tables (not shown) are housed. Such mill stands 118 may be those that have been removed from the rolling mill 14 and await inspection and refurbishing in the facilities adjacent the stand storage area, which includes a washing cabin 126 wherein the stands and mill rolls are cleaned, and a tilting device 128 for rotating the mill stands from horizontal to vertical positions, and vice versa.

At the end adjacent the tilting device 128 is a stand set-up area 130 wherein the mill stands may be disassembled in order to replace rolls and reassembled for placement in the stand storage area 122.

Intermediate the mill sections 112, 114 and 116 on the roll pass line 120 and the stand storage area 122 are quick change table means 132, here shown as being separate quick change tables 132*a*, 132*b* and 132*c*, each disposed adjacent one of the respective mill sections. Mechanism (not shown) is employed to enable the respective quick change tables 132 to move linearly forwardly and backwardly for controlled distances by means of a control device (also not shown).

Figure 11:
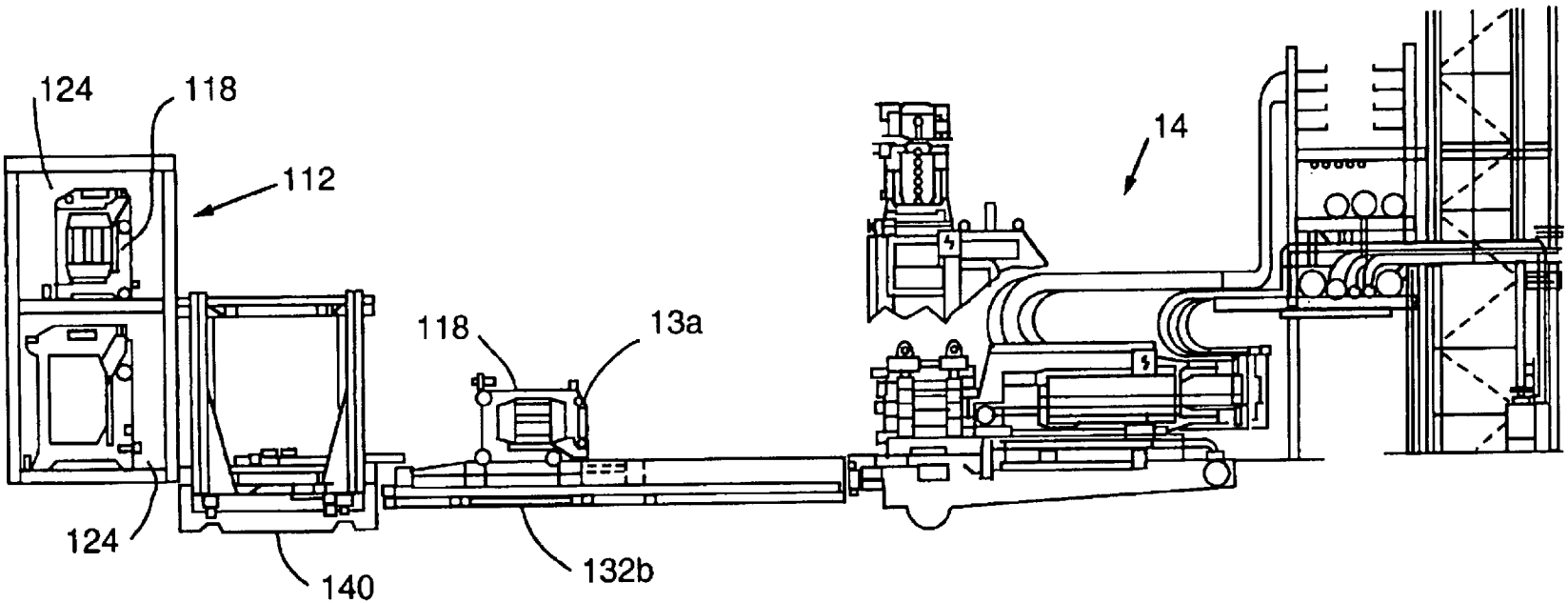
FIG. 11 is a view showing the stands storage area, stand storage robot, quick change device and rolling mill in accordance with the invention.
Figure 12:
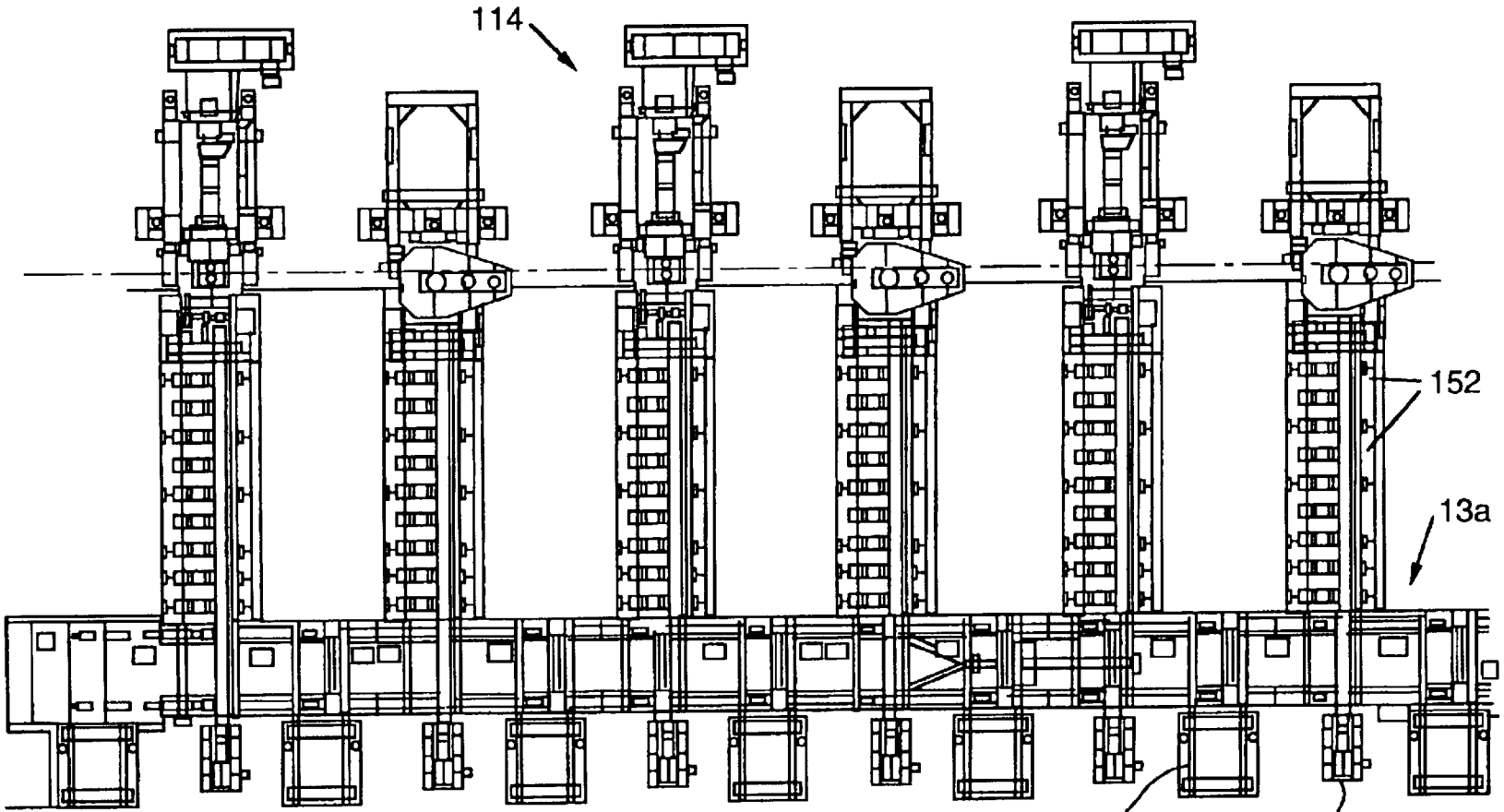
FIG. 12 is a plan view, of the quick change device.
Figure 13B:
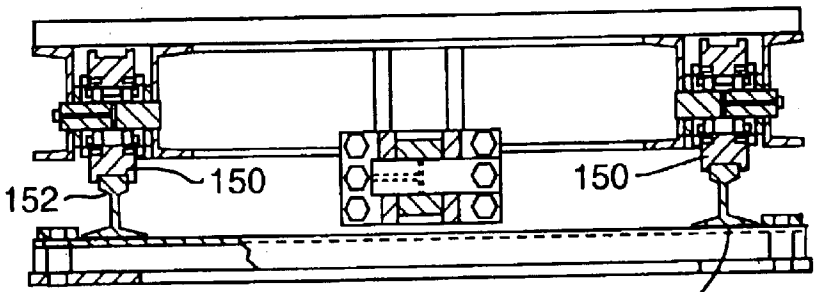
FIG. 13 is sectional views of the quick change device.
Figure 13D:
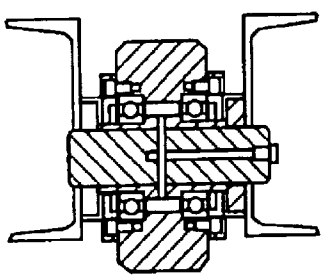
Figure 13A:
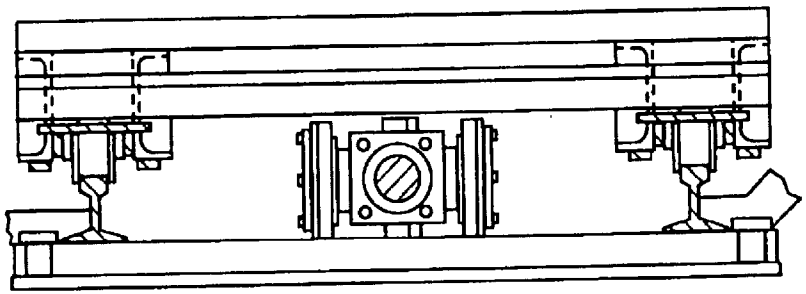
Figure 13C:
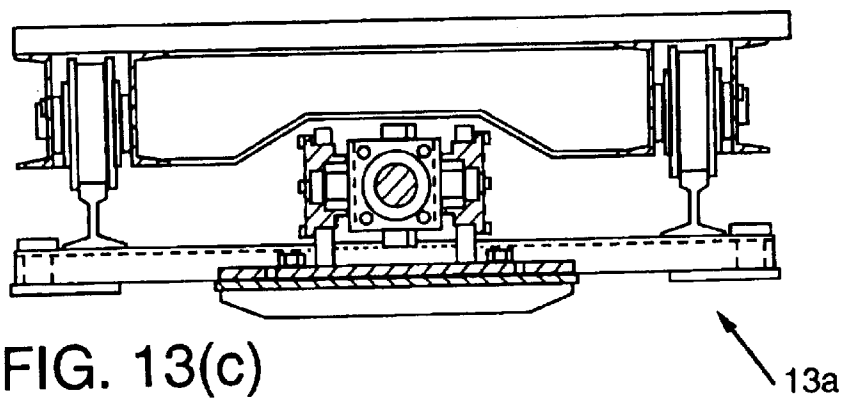

FIGS. 11 and 12 show the quick changing device 13*a* which is used for the removal and replacement of the stands. The cross sections of the quick change device are shown in detail in FIGS. 13(*a*), 13(*b*), 13(*c*) and 13(*d*). The motors 154, shown in FIG. 12, are used to handle the stands (by means, for example, of chain devices) from the quick change device 13*a* towards the rolling axis and vice versa. The stands move along the rails 152 on wheels 150 integrated on the stands. The stands which are on the quick change device 13*a* can be transferred on rails 152*b*, and vice versa. From said position, the stands can be collected or positioned by robot 138. Quick change device 13*a* can be translated in a direction parallel to the rolling axis on a wheeled system 150 and rails 152 due to control systems not shown.

Figure 10:
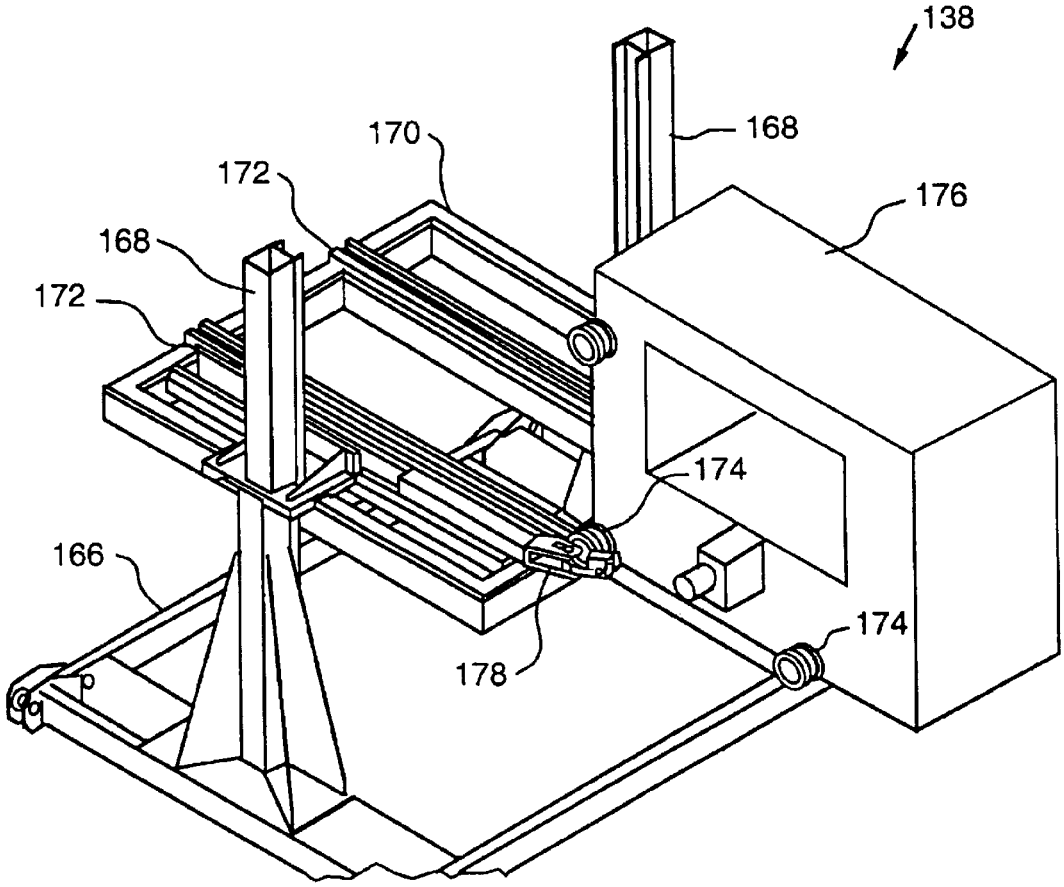
FIG. 10 is a partial perspective view of a typical stand storage robot.

For transferring mill stands 118 between the respective quick change tables 132 and the compartments 124 of the stand storage area 122 a plurality of mobile transfer devices or robots 138 are disposed to move along a robot way 140 that extends intermediate the quick change tables 132 and the stand storage area 122 and parallel to each. Each robot 138, a typical one of which is illustrated in FIG. 10, has the capability of controllably removing a mill stand from a quick change table 132 and transferring it to any selected compartment 124 of the stand storage area, to the washing cabin 126 for cleaning, to the tilting device 128 or to the stand set-up area 130. Conversely, the robots 138 also operate to move mill stands 118 from any of the aforementioned facilities to the quick change tables 132*a*, 132*b* or 132*c*.

As shown, each robot 138 comprises a frame 166 which is controllably movable on wheels along the robot way 140 and carries oppositely spaced upstanding posts 168 forming guideways for a vertically movable base 170. The base 170 has a pair of spaced, parallel tracks 172 that cooperate with stand wheels 174 for securing and manipulating a mill stand 176 to be moved along the robot way 140 for transfer between the quick-change table 132 and one or more of the washing cabin 126, the tilting device 128, or the stand setup area 130 prior to insertion in a selected compartment 124 of the stand storage area. Of course, a mill stand 118 removed from the rolling mill line can be transferred directly to the stand storage area. A stand operator 178 operates to move stand 176 along tracks 172.

The operation of the facility is explained by way of an example as follows. Upon completion of the rolling of a product, such as an elongated bar, rod, beam, angle, or the like, employing ten mill stands 118 is determined that the next product to be rolled requires the use of eight new stands, together with two bypass tables, to replace the ten mill stands used in the previous product run. It is further determined by a management program that the eight new stands 118 and two by-pass tables (not shown) are available at particular locations in compartments 124 of the stand storage area 122. At this stage, robots 138 are sequentially moved to positions along the robot platform 140 whereby the new mill stands 118 and bypass tables can be sequentially removed from their respective compartments 124 and placed in an assigned position next to the concerned quick change table 132. Next, the new mill stands 118 and by-pass tables are transferred onto the concerned quick change table or tables 132 by the mill stand transfer devices 136 referred to hereinbefore. The used mill stands 118 are likewise transferred onto the respective quick change tables 132*a*, 132*b* and/or 132*c* by the mill stand transfer devices 134.

The respective quick change tables 132, under the control of the management control system, are caused to move linearly in order to sequentially align the new mill stands 118 and by-pass tables with their respective assigned positions in the rolling mill train 14. The used mill stands 118 are similarly moved by the quick change tables 132 to positions from which they are extracted by robots 138, moved to the washing cabin 126 for cleaning, and thence to stand set-up area 130 or to the stand storage area 122 depending upon the needs of the respective mill stands 118. The new mill stands 118 and by-pass tables are, in the meantime, moved by mill stand transfer devices 136 to the rolling mill train 14 and are coupled to the relevant driving and control elements whereupon rolling of a new product can commence.

It will be appreciated that there is provided hereby a rolling mill operation in which the respective components are managed by a computer controlled in response to a database which contains particulars of production campaigns, lives of mill rolls and the product-defining channels therein, and the status of the respective components at any given time, whereby the administration of the respective components of the rolling mill is conducted automatically.

C. In-Line Heat Treatment of Stock

Figure 14:
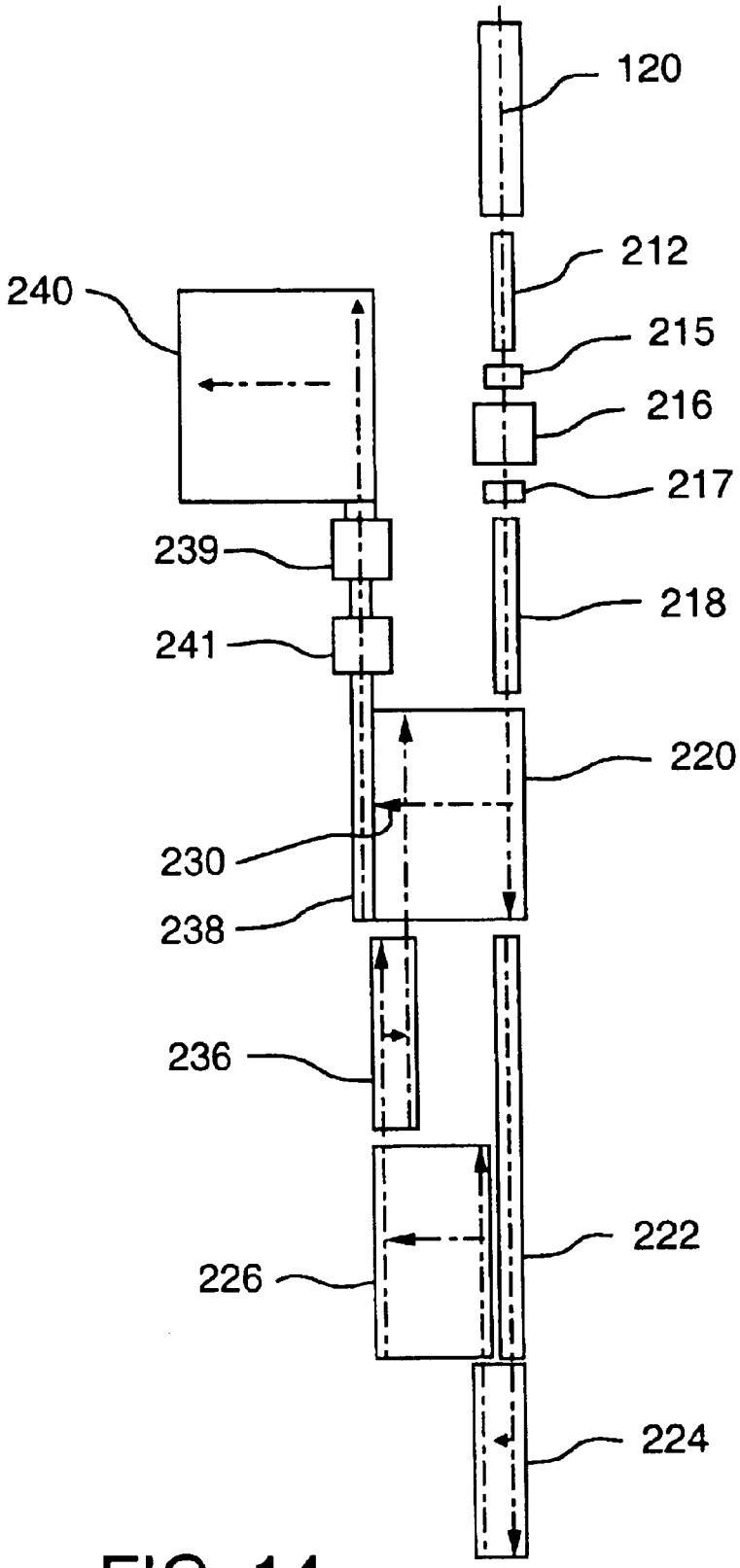
FIG. 14 is a schematic representation of the finishing area for in-line heat treatment as shown in FIG. 1.

As shown in FIG. 14 of the drawings, the metal product pass line, which is an extension of the roll pass line 120 shown in FIG. 8, contains, in-line, a controlling temperature device 212, a reduction and sizing block 216, quenching box 218, cooling bed 220 (optional), induction heaters 222, an integrated device comprising a layers preparation system 224, an annealing chamber 226, and a discharge system 236. Shears 215 and 217 are also provided for head and tail cutting and for cutting-to-length of the rolled stock. A water box 241, an on-line shot blasting 239 and a finishing area 240 are provided in-line downstream of cooling bed 220.

Figure 15A:
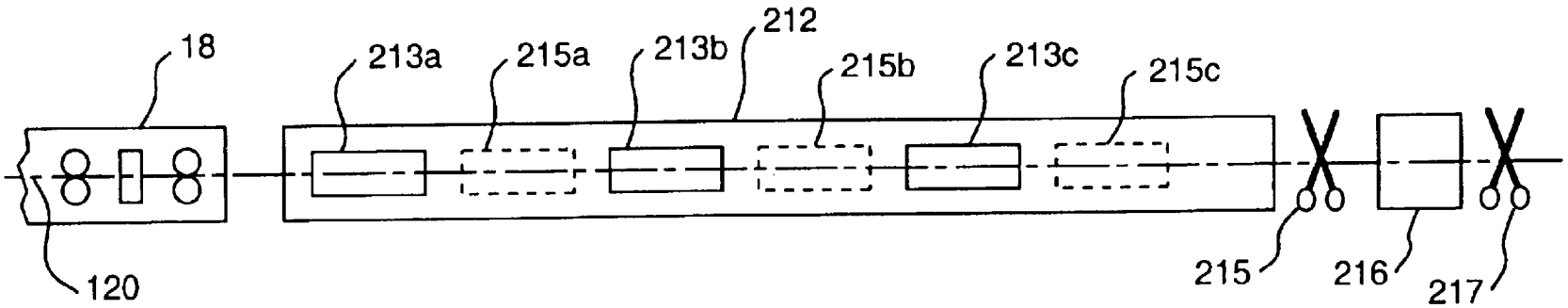
FIG. 15A is a schematic representation of the thermocontrolled rolling zone.

As can be seen in FIG. 15A, the temperature controlling device 212 is made up of a set of water boxes 213*a*, 213*b*, 213*c* and an area between the water boxes and the reduction and sizing block 216, with the aim of equalizing the rolled stock temperature. A set of inductors 215*a*, 215*b*, 215*c* can optionally be provided in an intermediate position between the respective water boxes. Selecting in this way either the water boxes or the inductors it is possible to control and subsequently equalize the rolled stock temperature before entry to reduction and sizing block 216. The controlling temperature device 212, together with the sizing and reduction block 216, permit thermocontrolled rolling of the bars. It is therefore possible to carry out according to the specific requirements either standard rolling, or normalizing rolling, or thermomechanical rolling.

Figure 15B:
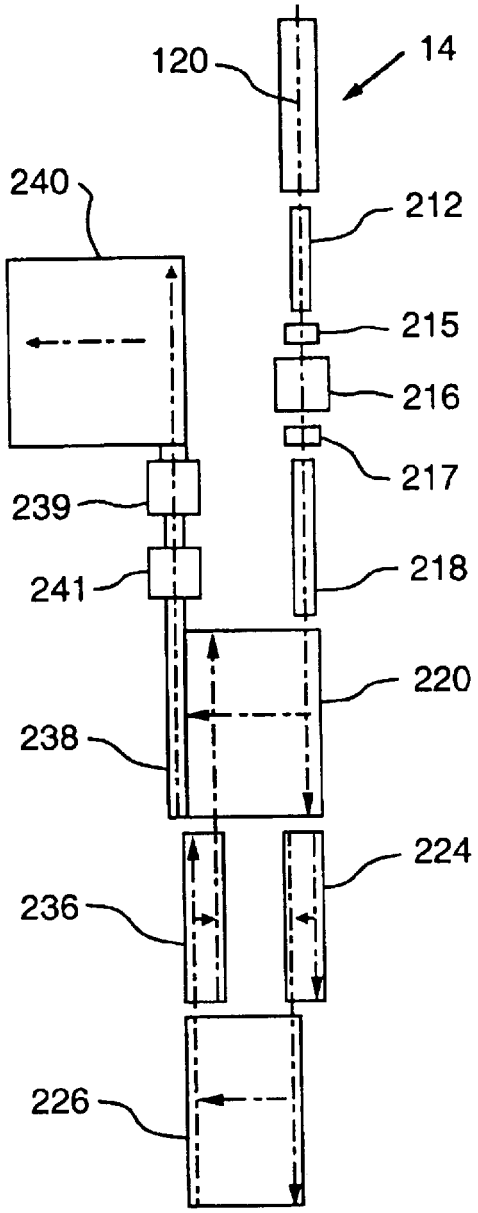
FIG. 15B is a schematic representation of compact variants of the finishing area for in-line heat treatments as shown in FIG. 1.
Figure 20:
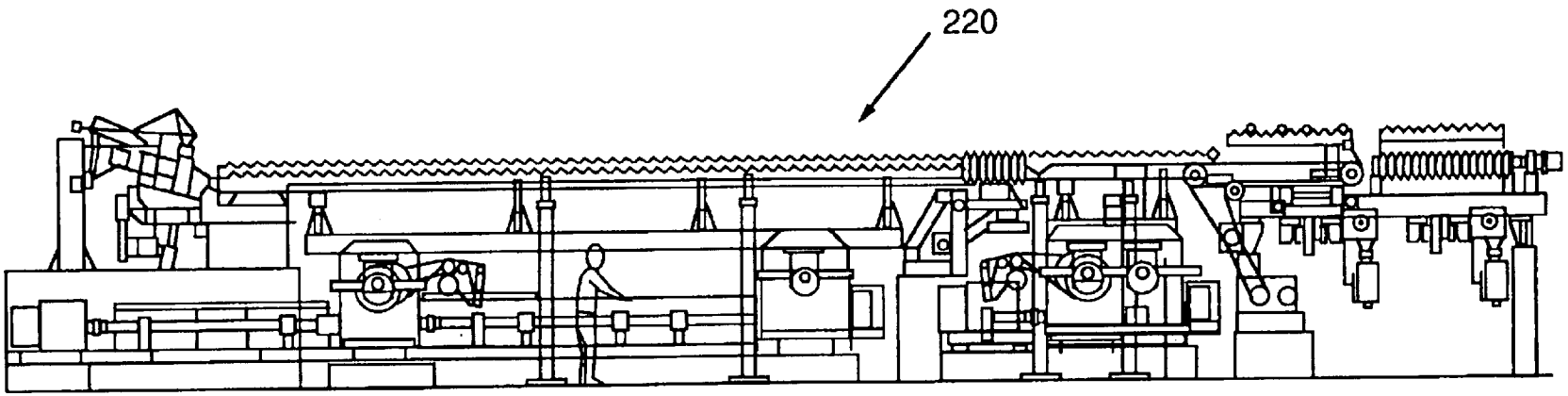
FIG. 20 is a partial elevational view of the cooling bed shown in FIG. 14.

Upon leaving the sizing apparatus 216 the bars are passed to a quenching box 218 in which they are controllably cooled to a predetermined temperature depending upon the desired heat treatment to be performed. Next, the bars may be passed to the induction heated furnace 222 wherein, depending upon the residence time of the bars within the furnace, the bars may be heated for tempering, if desired, or simply heated to an elevated temperature for further processing or for temperature equalization purposes. Alternatively, the bars may simply be diverted through the cooling bed 220, shown in FIG. 20, for cooling to about atmospheric temperature prior to discharge to a bar finishing area 228. In the arrangement shown in FIG. 15B, the induction heaters 222 have been eliminated and heating, if any, of the rolled product takes place directly in the annealing chamber 226 downstream.

Figure 16:
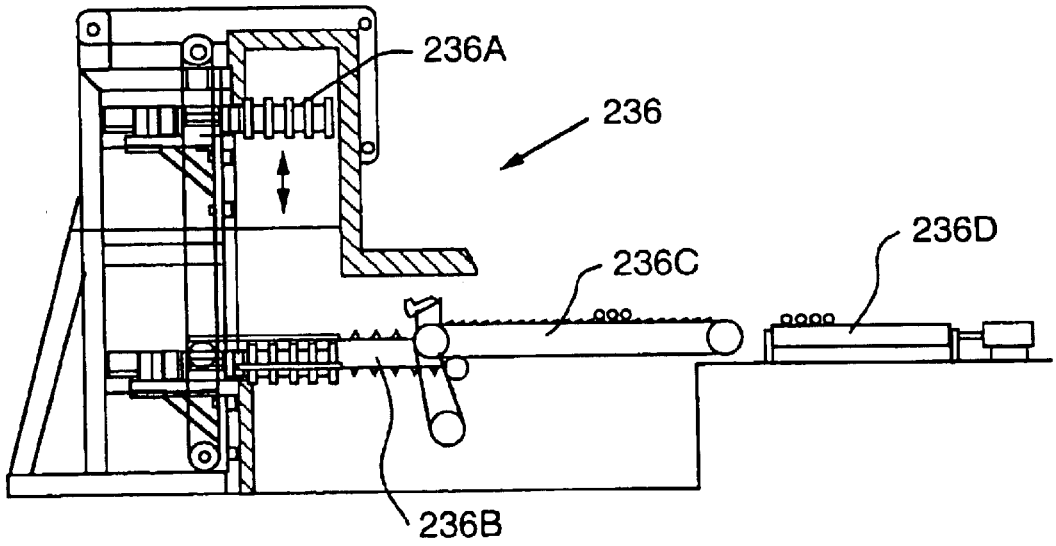
FIG. 16 is partial sectional elevation view of a discharging system shown in FIG. 14.
Figure 19:
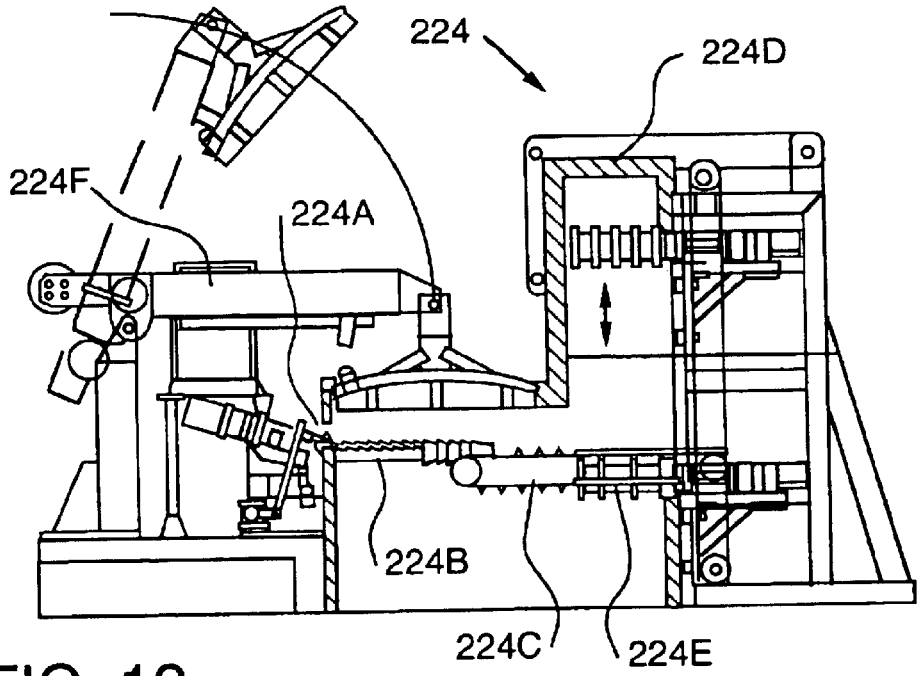
FIG. 19 is a partial sectional view of a layer forming system shown in FIG. 14.
Figure 17:
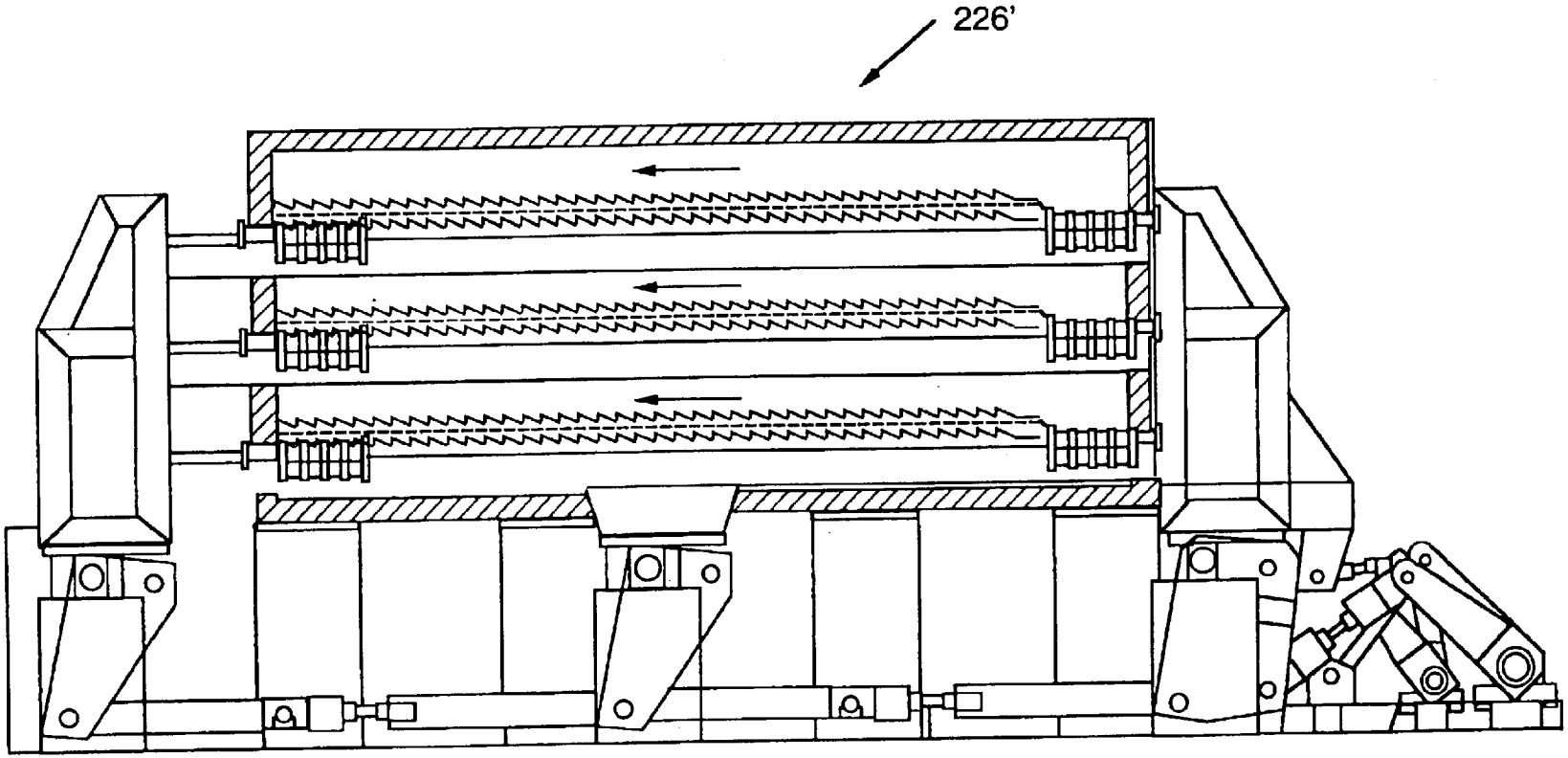
FIG. 17 is a sectional elevation view of a multilevel annealing furnace.

Following the induction heated furnace 222, the bars pass to a layers forming system 224, shown in FIG. 19, from which they are transferred to the annealing chamber 226. The layers forming system 224 includes an enclosing wall having an opening 224A forming an inlet through which bars are passed onto a conveyor 224B for transfer to a layer forming conveyor 224C. The layers, upon leaving conveyor 224C, are transferred to a liftable table 224E which operates to transfer the layers of bars to the annealing chamber 226. Desirably, the layers forming system 224 includes a pivotally retractable cover 224F for overlying the conveyor 224B. The use of a layer forming system similar to the one shown in FIG. 19 is associated in an advantageous manner to the use of an annealing chamber 226' like the one shown in FIG. 17. In this case the annealing chamber is arranged on two or more levels and is used for high productivity plants. The layers formed with the layer forming system, see FIG. 19, are conveyed via a liftable table 224E inside one of the annealing chamber levels. The layers inside the annealing chamber are moved horizontally so that they cover its whole length in a time equal to that set for the heat treatment. The layer handling device inside the chamber is typically a walking beam system. Treated bar layers are discharged by a device which is symmetrical to the feeding device, an example of which is shown in FIG. 16. The bar layer is kept in an insulated place up to the bar separation area in order to limit the cooling of same and guarantee good bar straightness. The layers descend from the various levels due to a liftable table 236A which collects the layer and places it on the transfer 236B. Separation occurs by means of a device similar to the one for layer preparation, arranging the bars on a cooling bed 236C without maintenance hoods where the bars can be cooled without causing straightness problems.

Other possible annealing chamber constructions suitable for use in the practice of the present invention are shown and described in U.S. patent application Ser. No. 09/315,847 now U.S. Pat. No. 6,036,485 filed concurrently herewith and the content thereof is incorporated herein by reference.

Figure 15C:
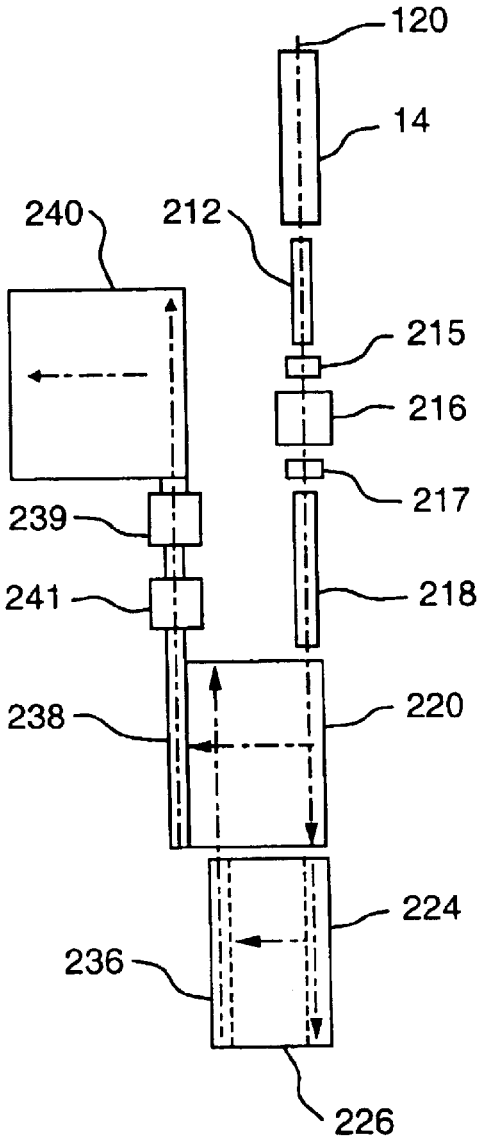
FIG. 15C is another schematic representation of compact variants of the finishing area for in-line heat treatments as shown in FIG. 1.
Figure 18:
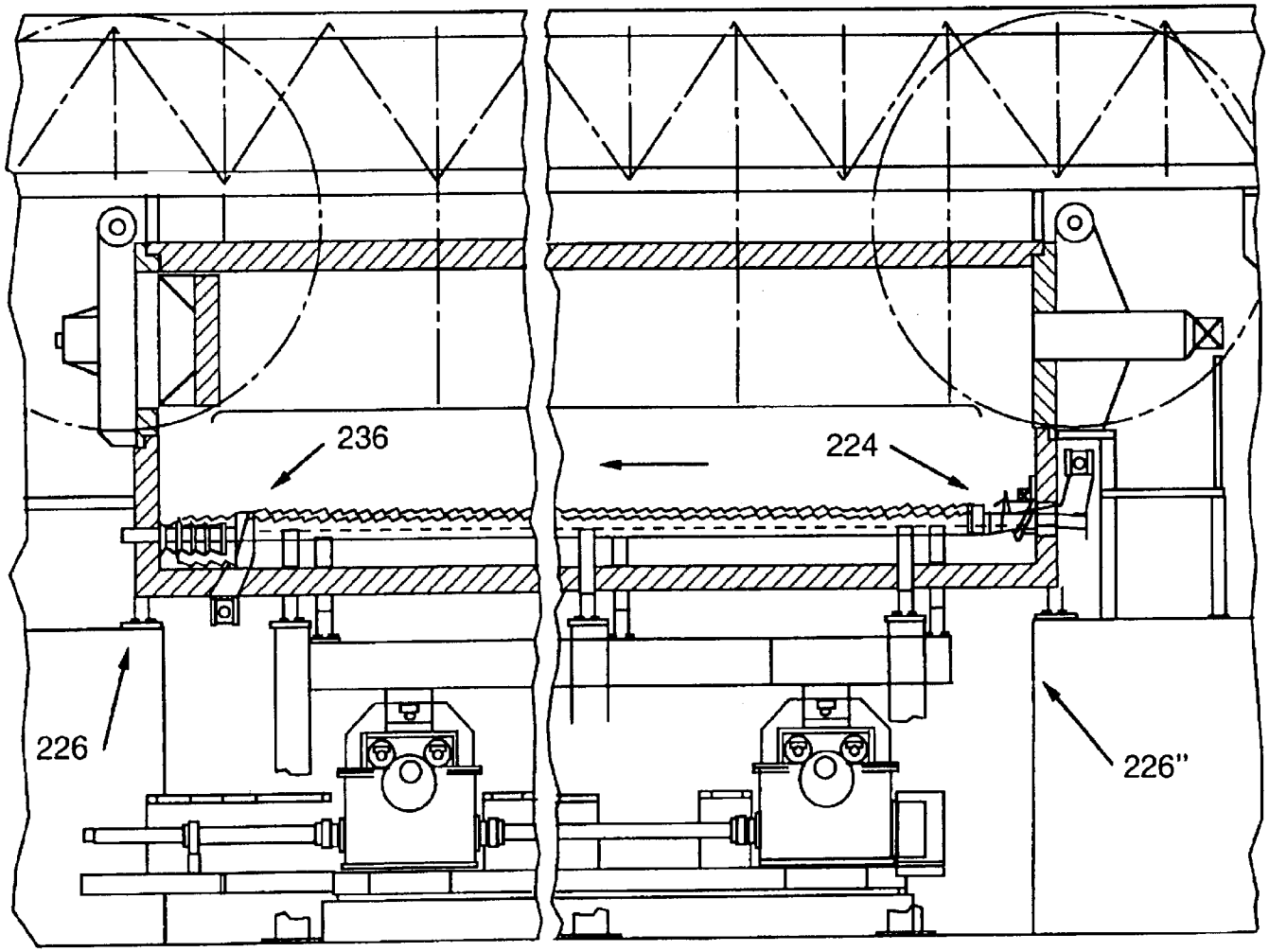
FIG. 18 is a sectional elevational view of a one-level annealing furnace including a layer preparation system and a discharge system.

The integrated device including the layer preparation system 224, annealing chamber 226 and discharge system 236, as described, is mainly used for high productivity plants. In low and medium productivity plants said system can be replaced with a system indicated as 226 having only one level, as shown in FIG. 18, where the layer preparation system and the discharge system are positioned directly inside the annealing chamber on one level only. In this case the over-all plant layout can be further simplified as shown in FIG. 15C.

Within the annealing furnace 226, depending upon the residence time of the bars within the furnace and the furnace operating temperature, the bars can receive a substantial range of heat treatments, such as tempering, workability annealing, spheroidizing-annealing, and slow cooling.

In operation, the general method of the invention for heat treating of steel stock hot rolled in a rolling mill includes the following possibilities conducted in-line with the rolling mill:

1. thermocontrolled rolling of the rolled stock in a thermocontrolled rolling zone constituted by a controlling temperature device 212 and a reduction and sizing block 216;
2. cutting the rolled stock into pieces of predetermined length;
3. sizing in a reduction and sizing block 216;
4. quenching the pieces of hot rolled stock in the quenching box 218;
5. heating the rolled stock in the induction heater 222;
6. preparing layers of predetermined numbers of pieces of stock in the layers preparation system 224 wherein the number of cut pieces of stock per layer depends on the section of the rolled stock and a following annealing time;
7. tempering and annealing the prepared layers of stock in the annealing furnace 226;
8. separating the layers into individual pieces of annealed stock in the discharge system 236; and
9. cooling the heat treated stock in the cooling bed 220, which, together with the other equipment, may be provided with a protective atmosphere, such as hydrogen/nitrogen or other suitable gases.

The particular times and temperature used in the several steps outlined above are selected for each individual product as dependant, for example, on composition and shape of the rolled product, and on its initially rolled and finally desired microstructure. Some specific examples follow.

For spheroidizing annealing the stock, the rolled stock is subjected to a thermocontrolled rolling using the controlling temperature device 212 and the reduction and sizing block 216 at a temperature of about 750° C. to about 850° C., then passed through the quenching box 218 and through the induction heating furnace 222 wherein no cooling or application of heat occurs therein. The thus-treated stock then is passed through the layers preparation system 224 where layers of cut pieces of stock are prepared. The layers of stock then are passed into the annealing furnace 226 at a temperature of from about 680° C. to about 720° C., and held therein for a time from about one hour to about two hours to spheroidize-anneal the stock. Thereafter, the cut pieces of stock in the layers are separated, and are passed through the cooling bed 220 where the product is cooled to substantially ambient temperature for subsequent in-line finishing, such as sandblasting, cutting to final form, and packaging.

In another variant of the general process, i.e. for shearability or workability annealing of the stock, the process is similar to the previously described process, except that the layers of stock are held in the annealing furnace 226 at a temperature of from about 630° C. to about 680° C. for a time from about 30 minutes to about 40 minutes.

For producing recrystallized annealed stock, the cast and rolled stock is subjected to thermo-controlled rolling in the thermocontrolled rolling zone containing the controlling temperature device 212 and the reduction and sizing block 216, and the thus-treated stock is annealed in the annealing furnace 226 at a temperature of about 800° C. and at a holding time of about 30 minutes to about 60 minutes.

For producing quenched stock, cut pieces of the cast and rolled stock are quenched in the quenching box 218. The induction heater 222, the layers preparation system 224, and the annealing furnace 222, the layers preparation system 224, and the annealing furnace 226 are by-passed and the quenched and tempered stock is passed directly to the cooling bed 220 and therein cooled to substantially ambient temperature.

As a still further example, a method for producing quenched and tempered stock, the cast and rolled stock is quenched in the quenching box 218, exits the quenching box at a temperature of from about 50° C. to about 150° C., then is optionally passed into the induction heater 222 and heated therein to the entry temperature to the annealing chamber 226 of from about 30° C. to about 500° C. and then held in the annealing chamber, where the temperature rises to about from 600 to 700° C. for a time of from about one hour to about two hours. The thus-treated stock then is passed directly to the cooling bed 220 and therein cooled to substantially ambient temperature.

Various other in-line treatments may be performed, for example, using the annealing furnace 226 for slow cooling of the product when such slow cooling is required for the treated products.

The overall apparatus of the invention, and the flexibility with which the several in-line items of equipment can be used or not used, and the wide range of choices of heating and cooling times and temperatures responsive, for example, to differing product chemistries and microstructures to produce a variety of different products provides a novel and extremely valuable tool in the production of cast and rolled products, such as bar products. As above noted, the invention also provides substantial and significant savings of time and energy costs as compared to conventional off-line heat treatment processes and facilities.

From the cooling bed 220 the processed bars are conducted via conveyor 238 to the water box 241 where they can be quickly cooled, especially after tempering, thereby reducing the stay time in the temperature range where the fragility of the tempering occurs (450–500° C.). If desired, the processed bars can be conducted to on-line shot-blasting device 239 prior to being discharged to the bar finishing area 240 from whence the bars are transferred to storage or to shipment via a transport facility (not shown).

D. Finishing Area for In-Line Treatment of Bars and Wire

Figure 21:
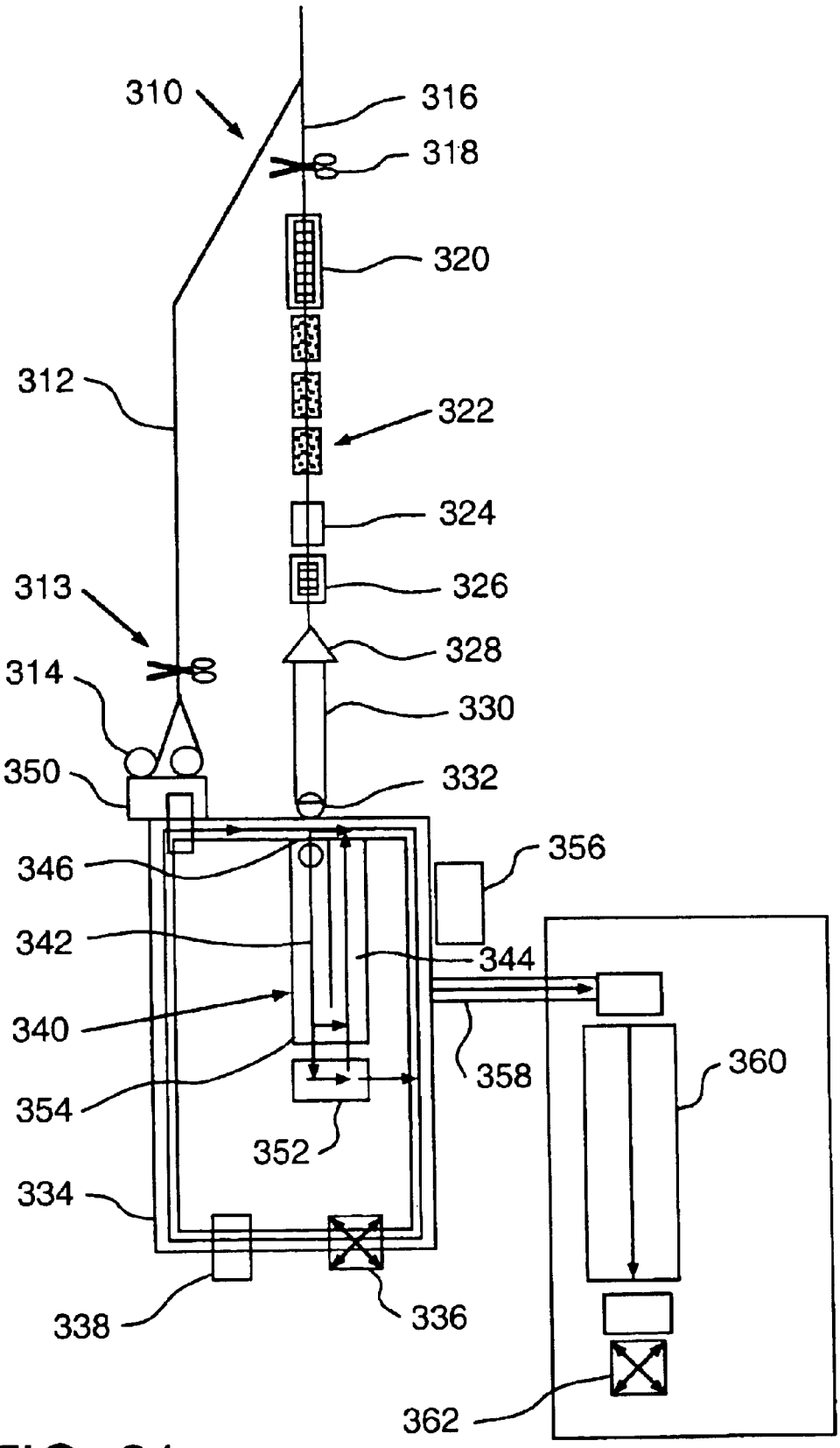
FIG. 21 is a schematic layout of the finishing area for in-line heat treatment of bars and wire rod shown in FIG. 1.

With particular reference to FIG. 21, there is shown a coil forming and heat treating facility 310 disposed in-line and downstream of the rolling mill 14 and, preferably, emanating from the mill line downstream of the reduction and sizing block 216. Desirably, larger diameter rod having diameters of from about 10 to about 60 mm, which has been rolled in the rolling mill 14 and sized in the reduction and sizing block 216, is directed by well known product diverting apparatus into a Garrett line 312 of known construction in which the product is cut into pieces of predetermined length by shear 313 and then is wound into one or more coils on coilers 314. Alternatively, a second line 316 is particularly adapted for the production of smaller size products, such as wire rod having diameters between about 4 mm and about 25 mm.

As shown in the drawings, the second line 316 desirably contains, in a consecutive in-line relationship, a crop shear 318, a finishing block 320, water cooling line 322, high speed shear 324 and twin module block 326, which are all operative in the production of smaller diameter wire rod. The second line terminates in coiling apparatus including laying head 328 for forming wire rod spirals, and a roller cooling conveyor 330 along which the spirals are conducted to a coiler 332.

A ring conveyor 334 defining an essentially closed annular path is located at the ends of the respective rod producing lines 312 and 316 with the coilers 314 and 332 at the ends of the respective lines being closely spaced with respect to each other along one peripheral side of the conveyor. Other work processing stations, including an inspection and testing station 336, a coil compacting and strapping station 338 and a weighing and discharging station 340, are disposed at spaced locations about the perimeter of the conveyor 334. The ring conveyor 334, which may be of the walking beam or roller table type, permits coils to be conducted to the respective stations around the conveyor and, following discharge of the coils, permits the trestles (not shown) upon which the coils are conveyed and from which they are removed upon discharge, to be returned to positions for receiving coils from coiler 332. (Trestles are not used for coils wound on coiler 314.)

This invention contemplates the conduct of in-line heat treatments to the coils conducted by the conveyor 334. Accordingly, as shown, an elongated annealing furnace 340 is arranged to receive coils to be treated from the conveyor 334. The furnace 340 preferably has a U-shaped construction being formed of two legs 342 and 344, each of which has an end 346 and 348, respectively, opening onto the conveyor 334. Preferably, end 346, here shown as defining the inlet to the furnace 340, is located substantially directly opposite the coiler 332 whereby coils formed on the coiler can be passed directly into the furnace leg 342.

Advantageously, the furnace 340 may be heated by burners supplied from a fuel source or by induction or other electric heating means. The heat to each leg 342 or 344 of the furnace 340 is independently controlled and, if desired, only one furnace leg can be heated to the exclusion of the other leg.

Other elements which are utilized in the heat treating procedures of the described apparatus include a first quench tank 350 disposed immediately adjacent the coiler 314 of the Garrett line 312. A second quench tank 352 is disposed intermediate the ends of the furnace 340, here shown as being adjacent the nexus 354 between the two furnace legs 342 and 344.

Fans 356 are disposed adjacent one peripheral side of the conveyor 334 whereby coils carried by the conveyor can be cooled by forced air cooling.

In the disclosed arrangement a conveyor offset 358 is optionally provided for conducting coils to a cold finishing facility 360 in which the coils may undergo such processing as pickling, phosphatizing and/or lubricating, or the like. Coils, after processing in this facility are passed to a coil compacting and strapping device 362 prior to discharge from the facility.

The operation of the herein described in-line small section steel stock coiling and heat treating facility for conducting various forms of heat treatment are as follows. For workability annealing coils of stock, which stock has undergone low temperature rolling using water cooling line 322 and twin module block 326 of the second line, the coils are introduced to the annealing furnace 340 immediately after being coiled on coiler 332. The coils are held in the furnace 340 for up to about two hours and at temperatures of from about 600° C. to about 850° C. The low temperature rolling of the stock before passing it to the furnace 340 significantly reduces the length of holding time for the coils in the furnace.

For workability annealing of the rod stock conducted along the Garrett line 312, the stock undergoes low temperature rolling using controlling temperature device 212 and reduction and sizing block 216 and, after winding into coils upon coiler 314 at the end of the Garrett line, the coils are conducted along the adjacent side of the ring conveyor 334 to the annealing furnace 340 for heating under conditions similar to those previously described.

For spheroidizing annealing the rolled stock, following thermomechanical or thermocontrolled rolling within a temperature range of from about 750° C. to about 850° C., the stock is wound into coils and immediately passed to the coil annealing furnace 340 for a period of from about one to about two hours for heating at temperatures within the range of from about 680° C. to about 720° C. wherein spheroidizing occurs. After thermal treatment the coils are returned to conveyor 334 for final air cooling.

For solubilization annealing for austenitic stainless steels, the stock, which has undergone normal rolling in the rolling mill 14, is coiled by coilers 314 at the end of the Garrett line 312 at a temperature of about 900° C. and immediately passed along conveyor 330 to the coil annealing furnace 340 for heating to about 1000° C. and for the time, between about thirty and sixty minutes, to achieve solution annealing. Typically this procedure will be formed in one leg 342 of the furnace 340 whereupon the coils, after achieving solution annealing, are quenched in the quench tank 352 and thence returned to the conveyor to be conducted to a point of final processing.

For recrystallization of ferritic steels the process is similar to that performed for solubilization annealing of austenitic stainless steels, except that the coils are heated only to within the range of from about 700° C. to about 800° C. in the coil annealing furnace 340 before quenching in quench tank 352.

When quenching and tempering is to be conducted on larger diameter rod material, the stock, after undergoing conventional rolling or thermocontrolled rolling in the section including the rolling mill 210, the controlling temperature device 212 and the reduction and sizing block 216 is coiled at a temperature of about 800° C. on the coilers 314 of the Garrett line 312. Immediately after coiling, the coils are quenched in quench tank 350 to a temperature of about 100° C. Thereafter, the coils are conducted by conveyor 334 to the coil annealing furnace 340 to be heated to the tempering temperature of between about 700° C. and 500° C. for a period of one to two hours. The coils are thereafter air cooled on the conveyor 334 before being passed for further processing or to discharge.

It is contemplated that patenting of the wire rod produced on the second line 316 can be performed by thermomechanically rolling the stock at about 850° C. and thereafter subjecting it to forced air cooling by fans placed in the roller cooling conveyor 330 prior to coiling.

It should be appreciated that following all of the foregoing forms of heat treatment, the coils are returned to conveyor 334 for transport to areas of further processing, as for example via conveyor offset 358 to the cold finishing facility 360 and final packaging by the compacting and strapping device 362 prior to shipment or storage.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A method for in-line heat treating of steel wire and bar product stock of varying cross sections and compositions, hot rolled in a rolling mill, comprising the combined steps, conducted in-line with the rolling mill, of:

a. cutting the rolled stock into pieces of predetermined length;

b. quenching the pieces of hot rolled stock in a quenching box;

c. in preparation for tempering of the quenched stock, preparing at least one layer of a predetermined number of cut pieces of stock in a layers preparation zone, with use of a layers preparation system, wherein the number of cut pieces of stock per layer depends on the section of the rolled stock;

d. tempering the prepared layer(s) of stock arranged in one or more level(s) in an in-line annealing furnace for controlled cooling, holding or heating of the layer(s) of stock for obtaining various metallurgical microstructures;

e. providing a separating and discharging device;

f. separating and discharging the layer(s) from the one or more level(s) into individual pieces of quenched and tempered stock with use of the separating and discharging device; and g. cooling the quenched and tempered stock in a cooling bed; wherein said items of equipment to carry out heat treatment of said stock of various cross sections are arranged in-line such that said heat treating steps and conditions are selectable in order to obtain the desired metallurgical microstructures for the various wire and bar product stock being heat treated while the wire and bar product stock is maintained in-line with the rolling mill.

2. A method according to claim 1, wherein the pieces of hot rolled stock coming from the quenching box have a temperature in the range 50 to 150° C.

3. A method according to claim 1, wherein tempering takes place while holding the layers of stock at a temperature in the range 500 to 700° C. for a time about 60 minutes to about 120 minutes.

4. A method according to claim 1, further comprising the step of induction heating the rolled and quenched stock in-line before preparing layers to help the following tempering of the rolled stock in the annealing furnace.

5. A method according to claim 1, wherein cooling in the quenching box is started from a temperature of about 800° C.

6. A method according to claim 1, further comprising a subsequent in-line finishing step selected from the group consisting of final cooling in a water box, shotblasting, cutting to final form, and packaging.

7. A method according to claim 1, wherein the cooling bed is provided with a protective atmosphere.

8. A method according to claim 1, wherein the number of levels in the in-line annealing furnace is two or more.

9. A method according to claim 1, wherein said layers preparation system in said layers preparation zone is positioned inside the in-line annealing furnace, and said separating and discharging device is positioned inside the in-line annealing furnace.

10. A method according to claim 1, wherein said layers preparation system in said layers preparation zone is positioned outside the in-line annealing furnace, and said separating and discharging device is positioned outside the in-line annealing furnace.

* * * * *